US008218999B2

(12) United States Patent
Furukawa et al.

(10) Patent No.: US 8,218,999 B2
(45) Date of Patent: Jul. 10, 2012

(54) WINDING MEMBER, CARTRIDGE, AND CARTRIDGE ASSEMBLING METHOD

(75) Inventors: Tetsuo Furukawa, Suntou-gun (JP); Hideki Nagae, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/306,162

(22) Filed: Nov. 29, 2011

(65) Prior Publication Data

US 2012/0070184 A1 Mar. 22, 2012

Related U.S. Application Data

(63) Continuation of application No. 12/472,283, filed on May 26, 2009, now Pat. No. 8,095,033.

(30) Foreign Application Priority Data

May 27, 2008 (JP) ..... 2008-138245

(51) Int. Cl.
*G03G 15/08* (2006.01)

(52) U.S. Cl. ..... 399/103; 399/102; 399/106; 399/109

(58) Field of Classification Search ..... 399/102, 399/103, 106, 111, 119, 262
See application file for complete search history.

(56) References Cited

U.S. PATENT DOCUMENTS

2001/0033756 A1* 10/2001 Shiratori et al. ..... 399/103
2002/0018668 A1* 2/2002 Kanno et al. ..... 399/106
2009/0297207 A1* 12/2009 Furukawa et al. ..... 399/106
2010/0221028 A1* 9/2010 Kihara et al. ..... 399/53

* cited by examiner

*Primary Examiner* — David Gray
*Assistant Examiner* — G. M. Hyder
(74) *Attorney, Agent, or Firm* — Canon U.S.A., Inc. IP Division

(57) ABSTRACT

A winding member winds a seal member that seals an opening of a developer storage unit. The winding member includes a first holding portion having a first engaging portion, and a second holding portion having a second engaging portion to be engaged with the first engaging portion, configured to hold the sealing member between the first and second holding portions, wherein an end of the first holding portion and an end of the second holding portion are connected, so that the first holding portion and the second holding portion are relatively movable, and wherein the first engaging portion is engaged with the second engaging portion while the sealing member is held between the first holding portion and the second holding portion.

15 Claims, 12 Drawing Sheets

FIG. 12B
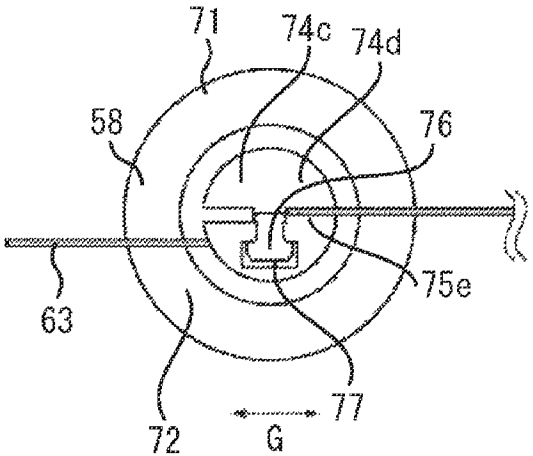
FIG. 12A
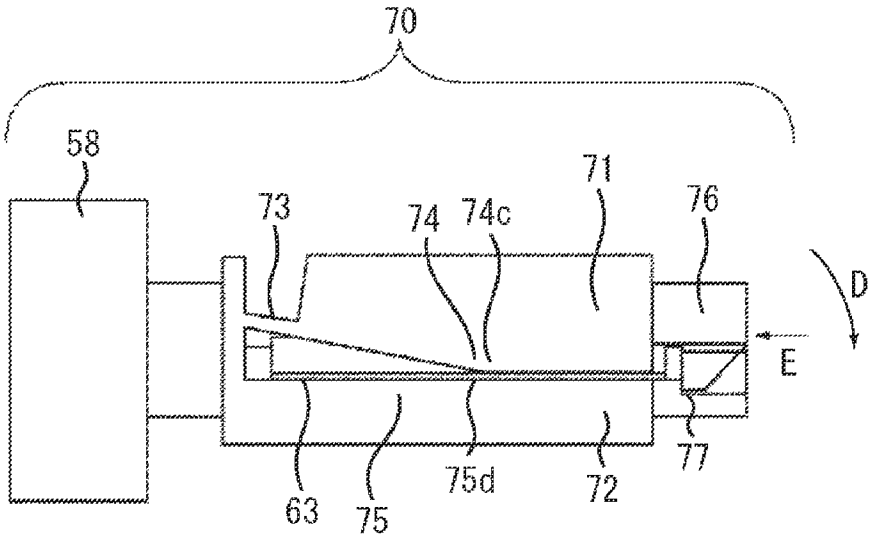
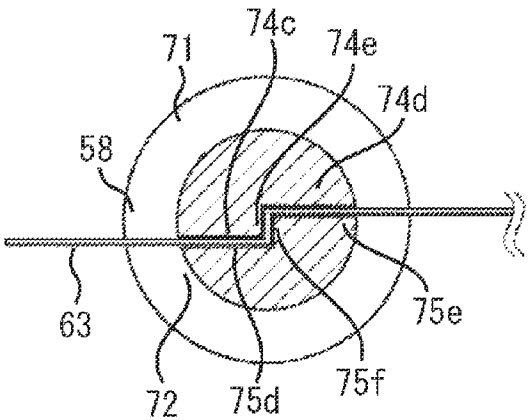
FIG. 12C

WINDING MEMBER, CARTRIDGE, AND CARTRIDGE ASSEMBLING METHOD

CROSS-REFERENCE TO RELATED APPLICATIONS

This application claims the benefit of U.S. application Ser. No. 12/472,283 filed May 26, 2009, and Japanese Patent Application No. 2008-138245 filed May 27, 2008, which are hereby incorporated by reference herein in their entireties.

BACKGROUND OF THE INVENTION

1. Field of the Invention

The present invention relates to a cartridge used in an electrophotographic image forming apparatus, a winding member used in the cartridge for winding a sealing member, and an assembling method for the cartridge.

2. Description of the Related Art

Conventionally, an electrophotographic photosensitive drum and a process unit, which performs processing on the electrophotographic photosensitive drum, are integrally formed in a cartridge in an electrophotographic image forming apparatus using an electrophotographic image forming process. The electrophotographic image forming apparatus employs a process cartridge system in which the above-described cartridge can be detachably mounted in the main body of an electrophotographic image forming apparatus.

The process cartridge system allows a user to perform the maintenance of the image forming apparatus without calling a serviceman, thus greatly improving the operability of the image forming apparatus. The process cartridge system is thus widely used in electrophotographic image forming apparatuses.

In an image forming apparatus, a beam of light modulated with image formation information is projected onto an electrophotographic drum (hereinafter referred to as a photosensitive drum) from a laser, an LED, a lamp, or the like. As a result, an electrostatic latent image is formed on the photosensitive drum.

A developing device then develops the electrostatic latent image, and the developed image formed on the photosensitive drum is transferred to the recording medium. The image is thus formed on the recording medium.

The process cartridge includes a developing roller as a developing unit for supplying developer (hereinafter referred to as toner) to the electrostatic latent image formed on the photosensitive drum. The process cartridge further includes a toner supplying roller that supplies toner to the developing roller, a developer container that includes a developer regulating member that regulates the toner on the developing roller, and a toner container that stores the toner.

Further, a toner discharge opening is provided on the toner container for supplying toner to the developer container. The toner discharge opening is sealed by a sealing member when a process cartridge is not yet used.

When the process cartridge is used for the first time, the user tears off the sealing member by pulling a pulling member (e.g., a pull tab) disposed on an end of the sealing member.

Moreover, the number of times for users to pull off the sealing member may increase, because color image forming apparatuses have been widely spread in these days.

There is a method of automatically removing the sealing member which seals the discharge opening by heat welding when the process cartridge is installed in the image forming apparatus main body (e.g., refer to U.S. Pat. No. 6,512,903). U.S. Pat. No. 6,512,903 discusses removing the sealing member by rotating a winding member to which one end of the sealing member is fixed, using a driving force transmitting device such as a motor-driven gear.

SUMMARY OF THE INVENTION

The present invention is directed to a winding member, a cartridge, and an assembling method for the cartridge that enable the easy assembling of the winding member and the sealing member.

According to an aspect of the present invention, a winding member that winds a sealing member that seals an opening of a developer storage unit, the winding member includes a first holding portion including a first engaging portion, and a second holding portion including a second engaged portion to be engaged with the first engaging portion, configured to hold the sealing member between the first and second holding portions, wherein an end of the first holding portion and an end of the second holding portion are connected, so that the first and second holding portions are relatively movable, and wherein the first engaging portion is engaged with the second engaging portion while the sealing member is held between the first and second holding portions.

According to another aspect of the present invention, a cartridge includes a developer storage unit having an opening, a sealing member configured to seal the opening, and a winding member configured to wind the sealing member by rotating, including a first holding portion with a first engaging portion, a second engaging portion to be engaged with the first engaging portion, and a second holding portion configured to hold the sealing member between the first and second holding portions, wherein an end of the first holding portion and an end of the second holding portion are connected, so that the first and second holding portions are relatively movable, and the first engaging portion is engaged with the second engaging portion while the winding member holds the sealing member between the first and second holding portions.

According to yet another aspect of the present invention, an assembling method for a cartridge that includes a developer storage unit for storing a developer with an opening, a sealing member configured to seal the opening, and a winding member configured to wind the sealing member, including a first holding portion with a first engaging portion engaging a second engaging portion of a second holding portion, configured to hold the sealing member between the first holding portion and the second holding portion, wherein an end of the first holding portion and an end of the second holding portion are connected, so that the first and second holding portions are relatively movable, and wherein the first engaging member is engaged with the second engaging portion while the winding member holds the sealing member to lock the sealing member, the method includes entering the sealing member between the first and second holding portions, and engaging the first and second holding portions while the sealing member is held between the first and second holding portions.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 12A, 12B, and 12C illustrate the winding member when holding the sealing member according to the third exemplary embodiment of the present invention.

DETAILED DESCRIPTION OF THE EMBODIMENTS

Various exemplary embodiments, features, and aspects of the invention will be described in detail below with reference to the drawings.

A process cartridge (hereinafter referred to as a cartridge) and a color electrophotographic image forming apparatus (hereinafter referred to as an image forming apparatus), in which the cartridge is detachably mountable according to a first exemplary embodiment will be described below.

Figure 2:
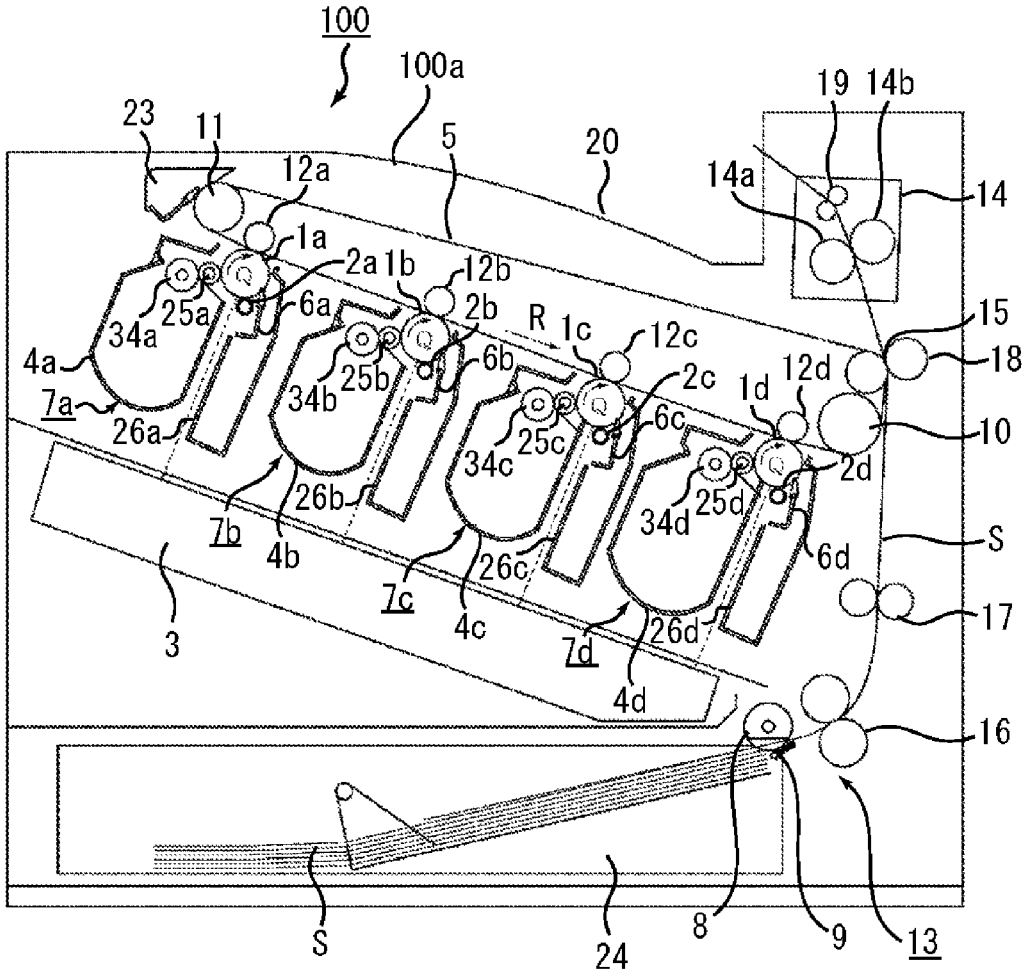
FIG. 2 illustrates an overall configuration of a color electrophotographic image forming apparatus according to an exemplary embodiment of the present invention.

FIG. 2 illustrates an overall configuration of the image forming apparatus.

Figure 4:
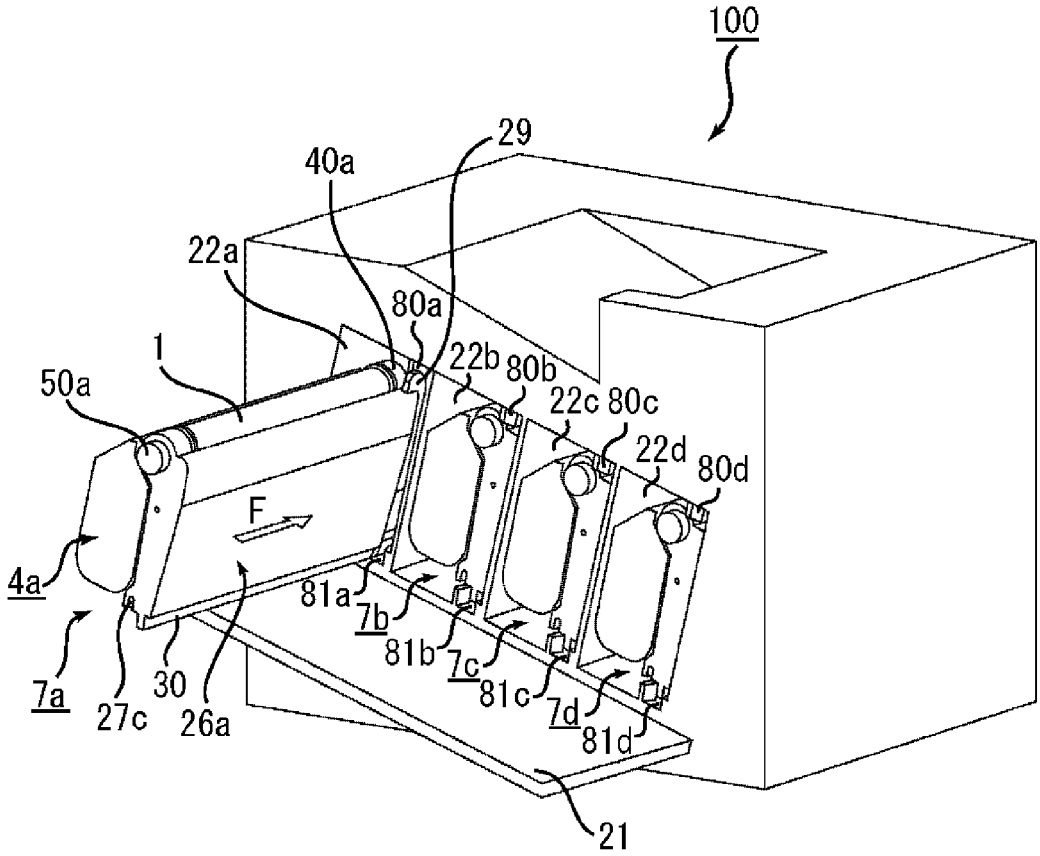
FIG. 4 illustrates a perspective view of the cartridge before being mounted in the image forming apparatus main body.

Referring to FIG. 2, an image forming apparatus 100 includes a mounting portion 22 (22*a*, 22*b*, 22*c*, and 22*d*) inclined with respect to a horizontal direction (refer to FIG. 4), into which four cartridges are adjacently mounted. Each of a cartridge 7 (7*a*, 7*b*, 7*c*, and 7*d*) mounted in the mounting portion 22 includes an electrophotographic photosensitive drum 1 (1*a*, 1*b*, 1*c*, and 1*d*).

The electrophotographic photosensitive drum (hereinafter referred to as photosensitive drum) 1 is rotated in a clockwise direction (i.e., in a direction of an arrow Q illustrated in FIG. 2) by a driving member (not illustrated).

Processing units that perform processing on the photosensitive drum are disposed around the peripheral surface of the photosensitive drum 1 in order, in terms of the rotational direction of the photosensitive drum 1. More specifically, a cleaning member 6 (6*a*, 6*b*, 6*c*, and 6*d*) that removes the developer (hereinafter referred to as toner) remaining on the surface of the photosensitive drum 1 after the image transfer, is disposed around the photosensitive drum 1. Further, a charging roller 2 (2*a*, 2*b*, 2*c*, and 2*d*) for uniformly charging the peripheral surface of the photosensitive drum 1, and a developing unit 4 (4*a*, 4*b*, 4*c*, and 4*d*) that develops the electrostatic latent image using toner, are disposed around the photosensitive drum 1.

Further, a scanner unit 3 that irradiates a laser beam according to image information and forms the electrostatic latent image on the photosensitive drum 1 is disposed around the photosensitive drum 1. An intermediate transfer belt 5 on which toner images of four colors on the photosensitive drum 1 are collectively transferred is also disposed around the photosensitive drum 1.

A cartridge 7 includes the photosensitive drum 1, the cleaning member 6, the charging roller 2, and the developing unit 4 as a cartridge. A user detachably mounts the cartridge 7 in an apparatus main body 100*a* of the image forming apparatus 100.

The intermediate transfer belt 5 is stretched around a driving roller 10 and a tension roller 11. Further, a primary transfer roller 12 (12*a*, 12*b*, 12*c*, and 12*d*) is disposed in the interior of the intermediate transfer belt 5, opposing each of the photosensitive drum 1 (1*a*, 1*b*, 1*c*, and 1*d*). Further, bias applying means (not illustrated) applies transfer bias on the intermediate transfer belt 5.

A toner image is formed on the photosensitive drum 1 which rotates in the direction indicated by the arrow Q illustrated in FIG. 2. The intermediate transfer belt 5 then rotates in a direction indicated by an arrow R illustrated in FIG. 2, and a bias of positive polarity is applied to the primary transfer roller 12. The toner image formed on the photosensitive drum 1 is thus sequentially primary transferred to the intermediate transfer belt 5.

After toner images of four colors are superposed on the intermediate transfer belt 5 by performing the above-described process, the toner images are conveyed to a secondary transfer portion 15.

A sheet S, i.e., a recording medium, is conveyed in synchronization with the above-described image forming process by a conveying unit including a sheet feeding apparatus 13 and a registration roller pair 17. The sheet feeding apparatus 13 includes a cassette 24 that stores the sheet S, a feeding roller 8 which feeds the sheet S, and a conveyance roller pair 16 which conveys the fed sheet S.

The cassette 24 can be pulled out towards the front side of the main body illustrated in FIG. 2. The sheet S stored in the cassette 24 is pressed by the feeding roller 8 and separated one by one by a separation pad 9 (separation pad method).

The sheet S is then conveyed from the sheet feeding apparatus 13 to the secondary transfer portion 15 by the registration roller pair 17. A bias of positive polarity is applied on the secondary transfer roller 18 at the secondary transfer portion 15. As a result, the four-color toner image on the intermediate transfer belt 5 is secondary transferred to the conveyed sheet S.

A fixing unit 14 fixes the toner image formed on the sheet S by applying heat and pressure on the sheet S. A fixing belt 14*a* of a cylindrical form is guided by a belt guide member (not illustrated) on which heating means such as a heater is adhered. Further, the fixing belt 14*a* and a pressure roller 14*b* forms a fixing nip by applying a predetermined press-contact force.

The sheet S on which an unfixed toner image is formed is conveyed from the image forming portion to the fixing nip between the fixing belt 14*a* and the pressure roller 14*b*, at which heat and pressure are applied to the sheet S. The unfixed toner image on the sheet S is thus fixed on the sheet S, and the sheet S is discharged onto a discharge tray 20 by a discharge roller pair 19.

The cleaning member 6 removes the toner remaining on the surface of the photosensitive drum 1 after the toner image is transferred. The removed toner is collected in a waste toner chamber disposed inside a photosensitive unit 26 (26*a*, 26*b*, 26*c*, and 26*d*).

Further, a transfer belt cleaning apparatus 23 removes the toner remaining on the intermediate transfer belt 5 after the secondary transfer is performed on the sheet S. The removed toner passes through a waste toner conveyance path (not illustrated) and is collected in a waste toner container (not illustrated) positioned on the far surface of the apparatus.

Figure 3:
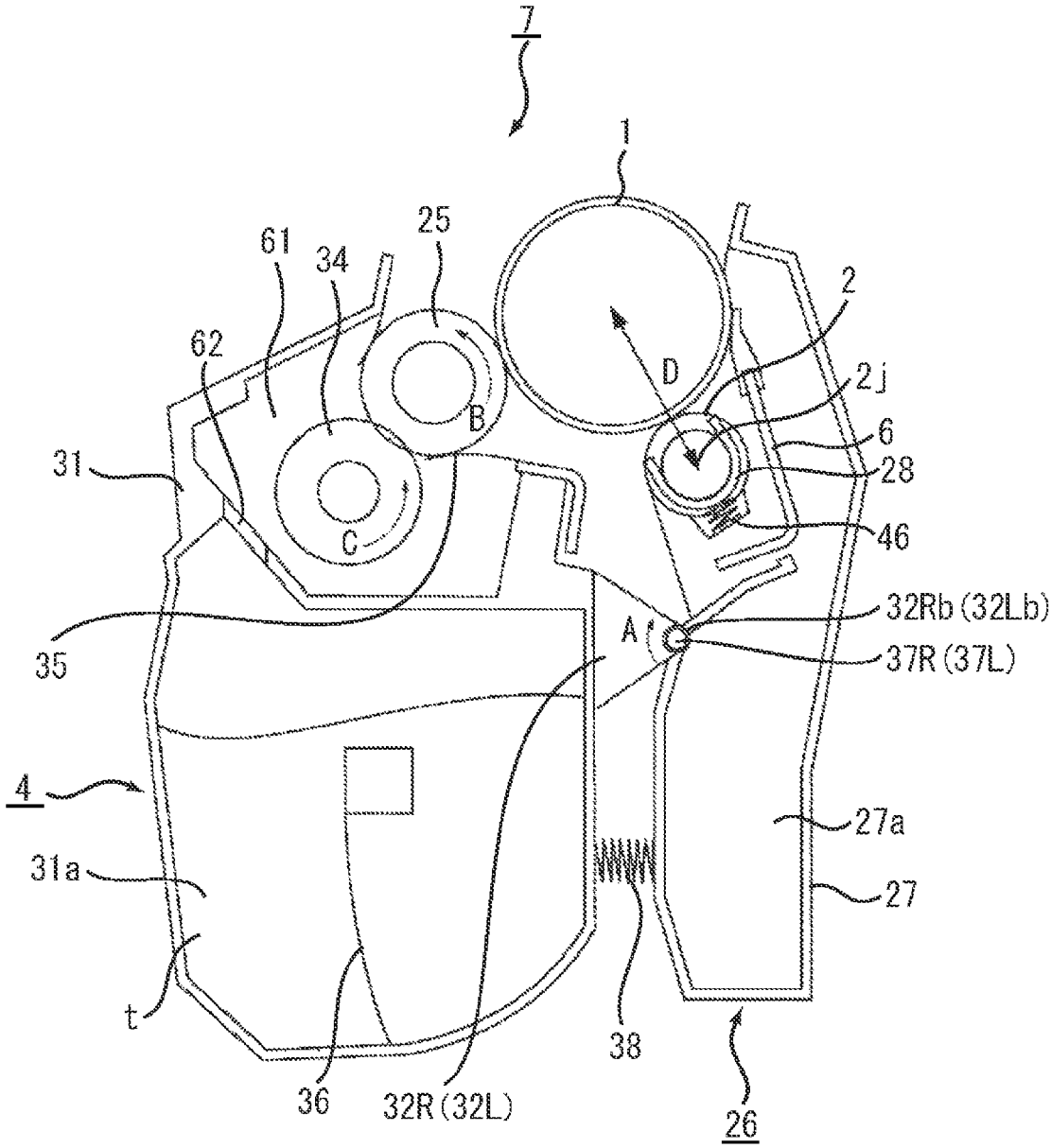
FIG. 3 illustrates a cross-sectional view of the cartridge.

The cartridge according to the present exemplary embodiment will be described below with reference to FIG. 3. FIG. 3 illustrates a main cross section of a cartridge 7 that contains a toner t.

A cartridge 7*a* containing yellow toner t, a cartridge 7*b* containing a magenta toner t, a cartridge 7*c* containing a cyan toner t, and a cartridge 7*d* containing a black toner t are similarly configured as the cartridge illustrated in FIG. 3.

The cartridge 7 is divided into the photosensitive member unit 26 including the photosensitive drum 1, the charging roller (i.e., charging unit) 2, and the cleaning member (i.e., cleaning unit) 6, and a developing unit 4 including the developing roller (i.e., developing unit) 25.

The photosensitive drum 1 is attached to a cleaning frame member 27 of the photosensitive unit 26 to be freely rotatable via a bearing to be described below. A driving force of a driving motor (not illustrated) is transmitted to the photosensitive unit 26, so that the photosensitive drum 1 is rotated according to the image forming operation.

The charging roller 2 and the cleaning member 6 are disposed around the peripheral surface of the photosensitive drum 1. Further, the residual toner removed from the surface of the photosensitive drum 1 by the cleaning member 6 falls into a waste toner chamber 27*a*.

A charging roller bearing 28 is attached to the cleaning frame member 27 to be movable in a direction indicated by an arrow D illustrated in FIG. 3, which passes through the center of the charging roller 2 and the center of the photosensitive drum 1. A shaft 2*j* of the charging roller 2 is rotatably attached to the bearing 28. Further, the bearing 28 is pressed towards the photosensitive drum 1 by a charging roller pressure member 46.

The developing unit 4 includes the developing roller 25, which is in contact with the photosensitive drum 1 and thus rotates in a direction indicated by an arrow B illustrated in FIG. 3. The developing unit 4 also includes a developing frame member 31. The developing roller 25 is supported by the developing frame member 31 to be freely rotatable, via a bearing member 32 (32R, 32L) attached to both sides of the developing frame member 31 in the longitudinal direction.

Further, a toner supplying roller 34 which is in contact with the developing roller 25 and thus rotates in a direction indicated by an arrow C, and a developing blade 35 which regulates a toner layer on the developing roller 25 are disposed around the periphery of the developing roller 25.

Further, a toner storage portion 31*a* (a developer storage portion) of the developing frame member 31 includes a toner conveying member 36 that agitates the contained toner and conveys the toner to the toner supplying roller 34.

Further, the developing unit 4 is connected to the photosensitive unit 26, rotatably around a shaft 37 (37R and 37L) that fits in holes 32Rb and 32Lb disposed on the bearing members 32R and 32L.

The developing unit 4 is biased by a pressure spring 38. As a result, when the cartridge 7 forms an image, the developing unit 4 rotates around the shaft 37 in a direction indicated by an arrow A, and the developing roller 25 comes into contact with the photosensitive drum 1.

The sealing member removal mechanism of the cartridge will be described below with reference to FIG. 5.

Figure 5:
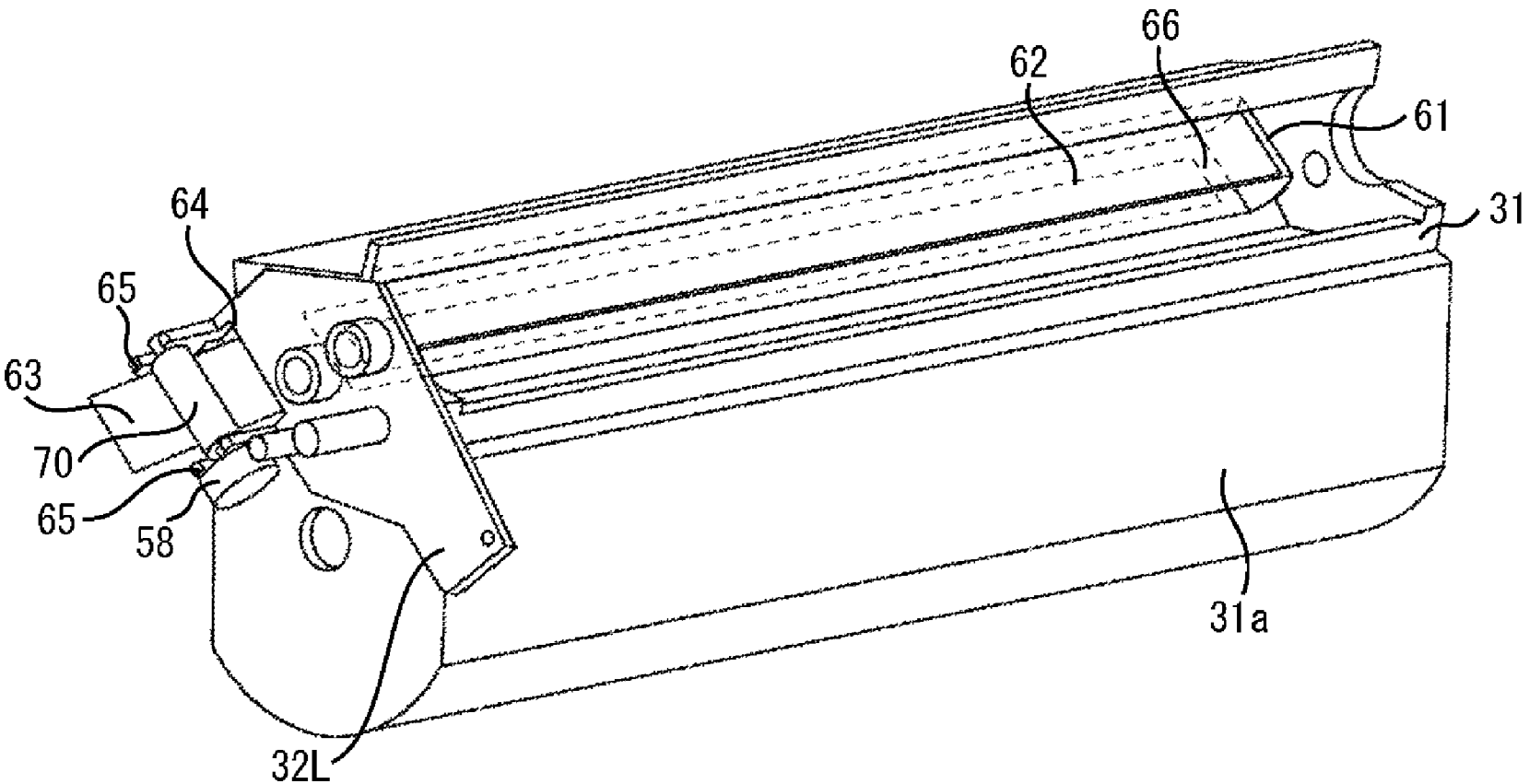
FIG. 5 illustrates a sealing member removal mechanism in the cartridge according to a first exemplary embodiment of the present invention.

Referring to FIG. 5, an opening 62 for supplying the toner is formed in the cartridge, between the toner storage unit 31*a*, which stores toner, and a developing chamber 61. The opening 62 is used to discharge the toner to the outside (i.e., developing chamber 61) of the toner storage unit 31*a*. The opening 62 is sealed by a sealing member 63 by heat welding, so that the toner is enclosed inside the toner storage unit 31*a*.

The sealing member 63 seals the opening 62 by elongating in a direction away from a near end of a winding member 70. The sealing member 63 is folded at a folding portion 66, extending back towards the winding member 70. The folded end of the sealing member 63 passes through a hole (not illustrated) of the developing frame member 31 and a hole 64 of the bearing member 32L. Then, the folded end of the sealing member 63 is fixed to the winding member 70.

A winding gear 58, i.e., a driving force receiving unit, is fixed to the winding member 70, and the winding member 70 winds the sealing member 63 by rotation of the winding gear 58. The winding member 70 is rotatably supported by a supporting portion 65 of the winding member 70 in the bearing member 32L fixed to the developing frame member 31.

The transmission of the driving force to the winding gear will be described below with reference to FIGS. 6A and 6B.

Figure 6A:
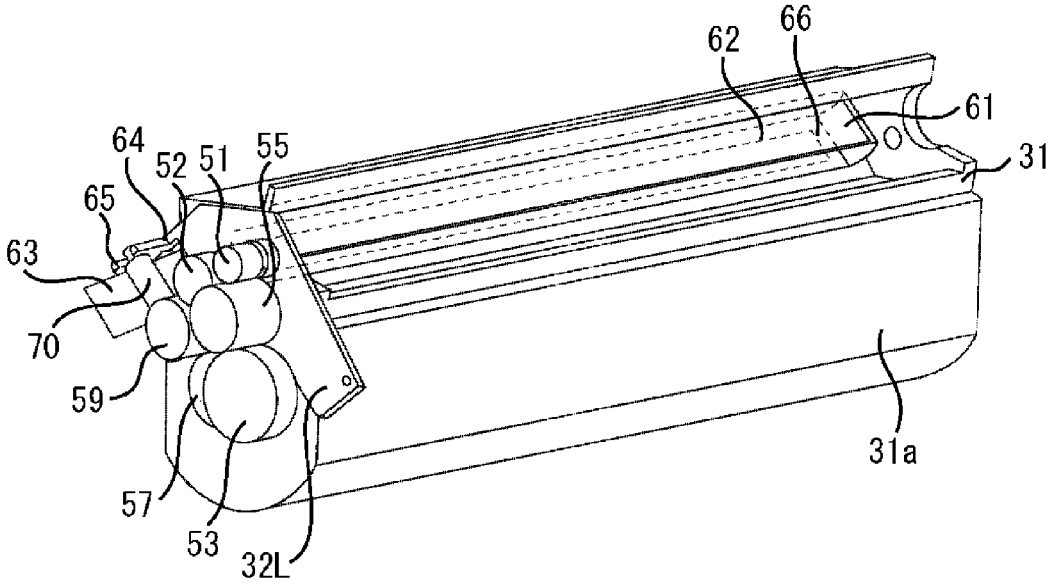
FIGS. 6A and 6B illustrate a perspective view of a driving force transmission train for removing the sealing member according to the first exemplary embodiment of the present invention.

FIG. 6A illustrates a perspective view of the driving force transmission train. The process cartridge is installed in the image forming apparatus 100 illustrated in FIG. 4. By transmitting the driving force from the image forming apparatus 100, the developing roller 25 (illustrated in FIG. 2) and thus a developing drive gear 51 attached to a rotational shaft of the developing roller 25 are rotated.

The driving force of the developing drive gear 51 is then transmitted to an idler gear 55. The transmitted driving force is branched from the idler gear 55 to a toner supplying gear 52 attached to a rotational shaft of the toner supplying roller 34 (illustrated in FIG. 3), the idler gear 53, and an idler gear 59 which is integrally connected with a worm gear 54 to rotate the worm gear 54.

Figure 6B:
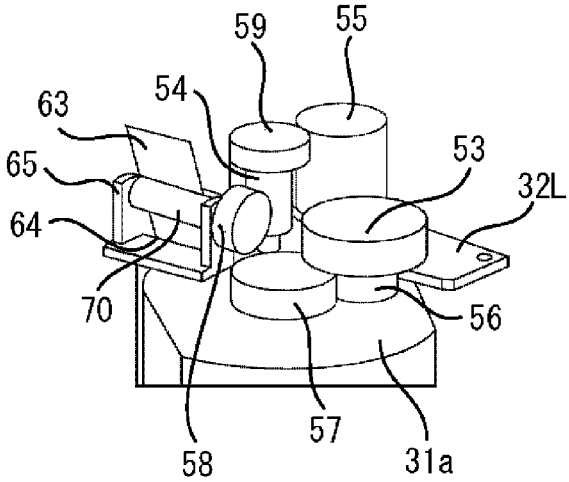

FIG. 6B illustrates the driving force transmission train as seen from a different direction.

The driving force of the idler gear 53 is transmitted to an agitating gear 57 that rotates the toner conveying member 36 (not illustrated), via a stepped gear 56 which is integrally connected with the idler gear 53. The driving force of the worm gear 54 is transmitted to a winding gear 58, so that the winding member 70 is rotated.

The configuration of the winding member used in the present exemplary embodiment will be described below with reference to FIGS. 1A and 1B and FIGS. 7A and 7B.

Figure 1B:
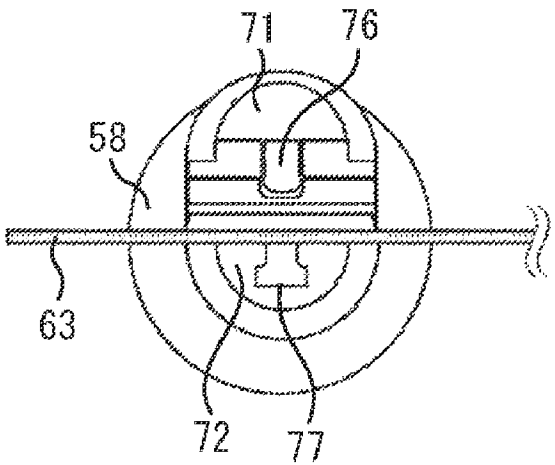
FIGS. 1A and 1B illustrate a winding member before the winding member holds the sealing member according to a first exemplary embodiment of the present invention.
Figure 1A:
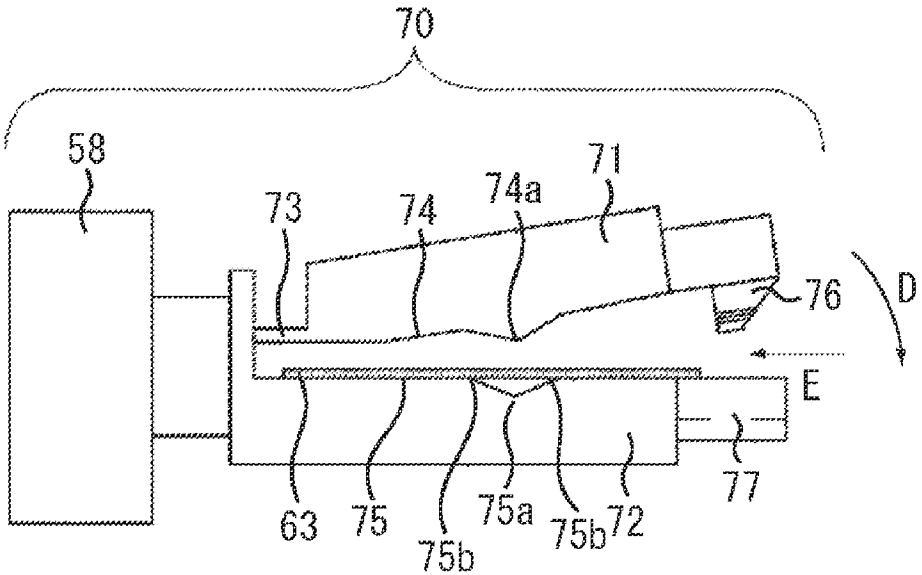

FIGS. 1A and 1B illustrate the winding member 70 before the winding member 70 holds the sealing member 63. More specifically, FIG. 1A illustrates the winding member 70 as seen from a direction which intersects (perpendicular to) the direction of the rotational axis of the winding member 70. Further, FIG. 1B illustrates the winding member 70 as seen from the direction of the rotational axis.

Referring to FIG. 1A, the winding member 70 includes holding portions 74 and 75 which are bifurcated in the direction intersecting the rotational axis of the winding member 70. More specifically, one ends of the holding portions 74 and 75 are connected along the rotational axis, and the other ends of the holding portions 74 and 75 are bifurcated into the intersecting direction with respect to the rotational axis.

Referring to FIG. 1A, a first holding portion 74 is a surface of a movable portion 71 opposing a fixed portion 72, and a second holding portion 75 is a surface of the fixed portion 72 opposing the movable portion 71.

Further, the movable portion 71 includes a thin-walled portion 73. When the movable portion 71 is deformed in a direction indicated by an arrow D illustrated in FIG. 1A so that the thin-walled portion 73 is bent, the first holding portion 74 and the second holding portion 75 hold one end of the sealing member 63.

If the first holding portion 74 is seen along the intersecting direction, the first holding portion forms an L-shaped surface with respect to a surface adjacent to the first holding portion 74 near the base of the bifurcated portion. In other words, the first holding portion 74 includes an inclined surface inclined in a direction away from the second holding portion 75, nearer to the base than a convex portion 74*a*.

The convex portion 74*a* disposed on the first holding portion 74, i.e., one side of the holding portion, biases the sealing member 63 when the sealing member 63 is held. Further, a concave portion 75*a* is formed on the second holding portion 75, i.e., the other side of the holding portion, to avoid interference.

Further, a convex portion 76, i.e., an engaging portion (i.e., first engaging portion), is disposed at a leading edge of the movable portion 71, and a concave portion 77, i.e., an engaged portion (i.e., second engaging portion), is disposed at a leading edge of the fixed portion 72, to keep holding the sealing member 63.

The sealing member 63 is pulled into the winding member 70 between the first holding portion 74 and the second holding portion 75, from a direction indicated by an arrow E illustrated in FIG. 1A. More specifically, the sealing member 63 enters between the first holding portion 74 and the second holding portion 75 (i.e., an entering step).

Figure 7B:
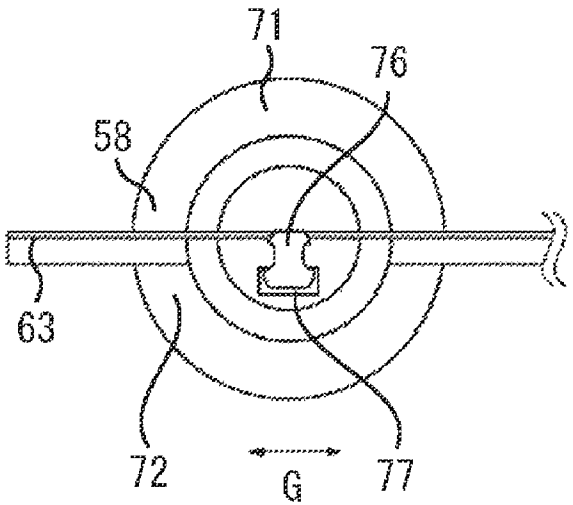
FIGS. 7A and 7B illustrate the winding member when holding the sealing member according to the first exemplary embodiment of the present invention.
Figure 7A:
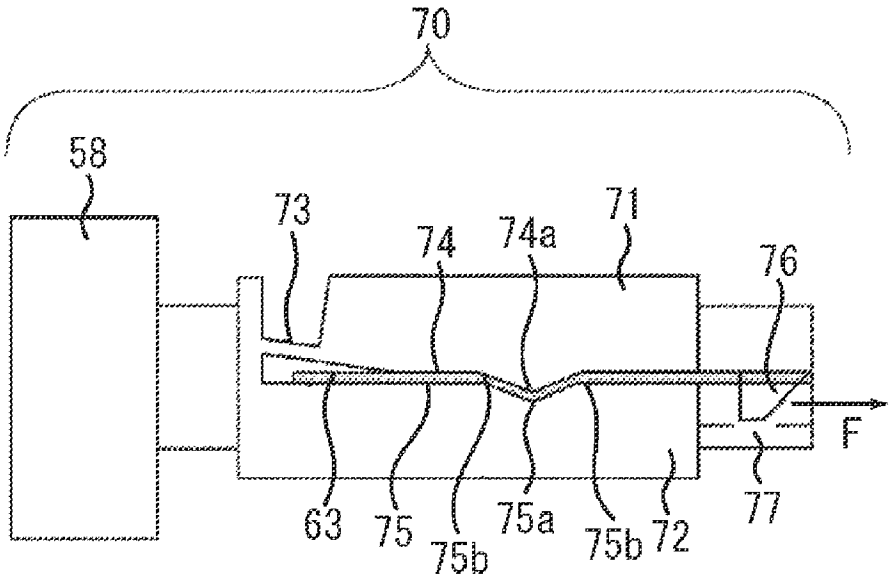

FIGS. 7A and 7B illustrate the winding member 70 when holding the sealing member 63. More specifically, FIG. 7A illustrates the winding member 70 as seen from the direction intersecting the rotational axis of the winding member 70. Further, FIG. 7B illustrates the winding member 70 as seen from the direction of the rotational axis.

Referring to FIG. 7A, the first holding portion 74 and the second holding portion 75 hold the sealing member 63 by bending the thin-walled portion 73 of the winding member 70 and moving the movable portion 71 towards the fixing portion 72. The convex portion 74*a* of the first holding portion 74 biases the sealing member 63.

The convex portion 76 is then engaged with the concave portion 77 (i.e., engaging step) to keep the sealing member 63 holding there between the two portions.

When the winding member 70 is holding the sealing member 63, the convex portion 76, i.e., the engaging portion, prevents the sealing member 63 from sliding off in a direction indicated by an arrow F illustrated in FIG. 7A.

Further, the distance between the portion where the convex portion 76 and the concave portion 77 are engaged (i.e., engaged point) and the base (i.e., connecting point) of the holding portion bifurcated in the direction intersecting the rotational axis of the winding member 70, is longer than the width of the sealing member. Therefore, the sealing member 63 is locked between the engaging portion and the connecting portion.

The winding gear 58 is positioned at the end of the winding member 70, as compared to the connecting point. In other words, the connecting point is located between the winding gear 58 and engaging point at which the convex portion 76 and concave portion 77 are engaged. This is to prevent a winding failure. Without this configuration, for example, the convex portion 76 may press the sealing member 63 when engaging with the concave portion 77, so that the sealing member 63 may be scratched or punctured. By the above-described configuration, the sealing member 63 is not torn from the hole when the winding member 63 is wound.

Further, the convex portion 74*a* sinks more deeply into the concave portion 75*a* (i.e., the convex portion 74*a* enters the concave portion 75*a*) as compared to other portions in the second holding portion 75. Therefore, the sealing member 63 is firmly biased even if the space between the first holding portion 74 and the second holding portion varies within dimensional tolerance.

As a result, the sealing member 63 is firmly held at three points, i.e., the convex portion 74*a* and concave portion corners 75*b*. The sealing member 63 is thus prevented from sliding off in a direction indicated by an arrow G illustrated in FIG. 7B.

In the above-described case, it is desirable that the angles of each of the corners of the convex portion 74*a* and the concave portion corners 75*b* are obtuse. If the corners are obtuse angles, it can prevent the sealing member 63 from being torn, or prevent a winding failure when the sealing member 63 is held by the winding member 70.

Further, when the first holding portion 74 is viewed along the intersecting direction, the first holding portion 74 is L-shaped with respect to the surface adjacent to the opposing surface near the base of the bifurcation. As a result, an area between the first holding portion 74 and the second holding portion 75 at which the sealing member 63 is held can be increased.

Therefore, the force for holding the sealing member 63 between the first holding portion 74 and the second holding portion 75 can be increased, and the sealing member 63 can be prevented from sliding off from the holding portion 74 and the holding portion 75.

In particular, if the thickness of the sealing member 63 is thinner than the space between the thin-walled portion 73 and the holding portion 75, the sealing member 63 cannot be held in the portion between the thin-walled portion 73 and the first holding portion 74. Therefore, the L-shaped first holding portion 74 is useful for increasing the area between the first holding portion 74 and the second holding portion 75.

Further, the concave portion 74*a* which biases the sealing member 63, and the concave portion 75*a* which is formed to avoid interference with the concave portion 74*a*, are shaped so that differences in heights can be confirmed as seen from the direction intersecting the rotational axis of the winding member 70.

More specifically, the convex portion 74*a* and the concave portion 75*a* are formed in a direction approximately perpendicular to the rotational axis of the winding member 70. As a result, the area where the sealing member 63 is held between the first holding portion 74 and the second holding portion 75 by portions other than the concave portion 74*a* and the convex portion 75*a* can be increased.

Further, according to the present exemplary embodiment, when the sealing member 63 is pulled, a force acting to disengage the convex portion 76 and the concave portion 77 may be applied less than that applied when the convex portion 74*a* and the concave portion 75*a* are formed along the rotational axis of the winding member 70.

In one embodiment, the convex portion 74*a* and the concave portion 75*a* may be shaped so that the difference in the steps can be confirmed as seen from the direction of the rotational axis of the winding member 70. In such a case, the area where the sealing member 63 is held between the first holding portion 74 and the second holding portion 75 by portions other than the concave portion 74*a* and the convex portion 75*a* becomes smaller, and the force for holding the sealing member 63 becomes weak. Therefore, the shapes according to the present exemplary embodiment are more effective.

In the present exemplary embodiment, the winding member 70 is bifurcated in the direction perpendicular to the rotational axis of the winding member 70 into the movable portion 71 and the fixed portion 72. However, both sides can be movable portions.

In the present exemplary embodiment, one side of the winding member 70 is fixed, so that the sealing member 63 can be more easily held.

Figure 8A:
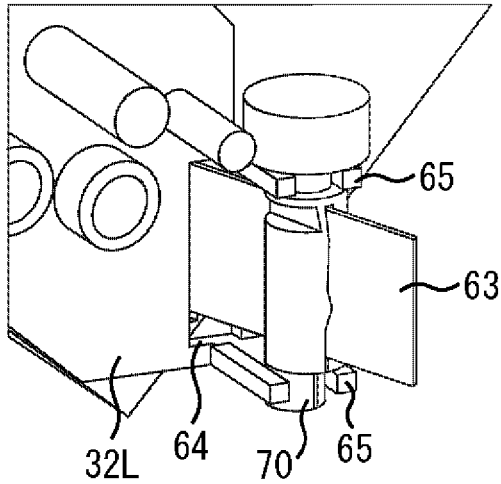
FIGS. 8A, 8B, and 8C illustrate the winding member winding the sealing member according to the first exemplary embodiment of the present invention.
Figure 8B:
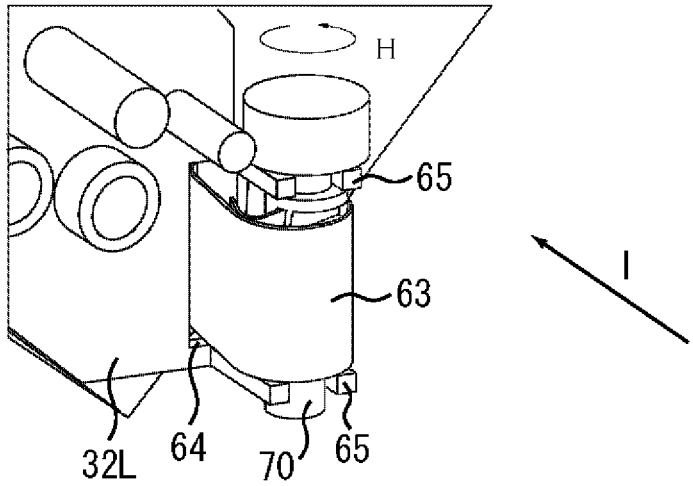
Figure 8C:
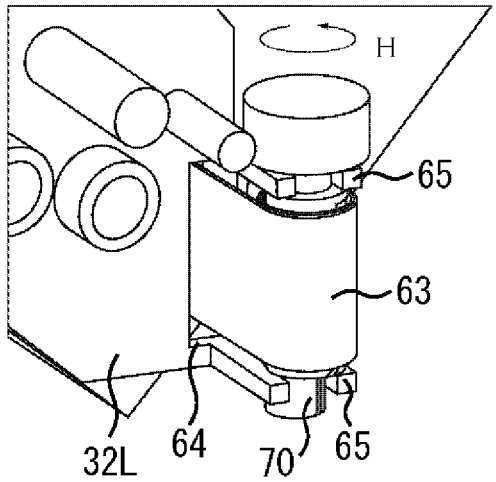

FIGS. 8A, 8B, and 8C illustrate the winding member 70 winding the sealing member 63 (wherein gears other than the winding gear are not illustrated).

FIG. 8A illustrates the winding member 70 before the winding member 70 winds the sealing member 63. Referring to FIG. 8A, after the winding member 70 holds the sealing member 63, the winding member 70 is rotatably mounted on a supporting portion 65 of the bearing member 32L fixed to the developing frame member 31 (i.e., supporting step). The supporting portion 65 supports the winding member 70.

FIG. 8B illustrates the winding member 70 starting to wind in the sealing member 63. Referring to FIG. 8B, the winding member 70 is rotated in a direction indicated by an arrow H illustrated in FIG. 8B, so that the sealing member 63 winds itself in. A cover member (not illustrated) is then attached in a direction indicated by an arrow I illustrated in FIG. 8B (i.e., from the front side to the rear side of FIG. 8B).

FIG. 8C illustrates the winding member 70 winding the sealing member 63. If the cover member (not illustrated) is attached while the winding member 70 is rotating and thus winding the sealing member 63, the sealing member 63 may be caught in the cover member (not illustrated) and cause a winding failure. To prevent this, the winding member 70 may be assembled in the state illustrated in FIG. 8B.

As described above, according to the present exemplary embodiment, the sealing member 63 and the winding member 70 which winds the sealing member 63 can be easily and firmly fixed.

Further, manufacturing cost can be reduced by a decrease in the number of components, and assembling efficiency can be improved.

Further, a winding failure caused by the sealing member 63 being caught in surrounding components can be prevented by mounting the cartridge while the sealing member 63 winding itself in (winding step).

Further, a similar result as the above-described exemplary embodiment can be achieved even if a plurality of the convex portion 74*a* and the concave portion 75*a* for holding the sealing member 63 are disposed, or even if the convex portion 74*a* and the concave portion 75*a* are reversely positioned.

A second exemplary embodiment of the present invention will be described below with reference to FIGS. 9A and 9B.

In the present exemplary embodiment, a developing apparatus, a process cartridge, an image forming apparatus, and a sealing member removal mechanism are similar to those described in the first exemplary embodiment, except for the winding member 70. Therefore, the same reference number will be assigned to components of the similar function and the similar configuration, and detailed description will be omitted.

A configuration of the winding member according to the present exemplary embodiment will be described below with reference to FIGS. 9A and 9B.

Figure 9B:
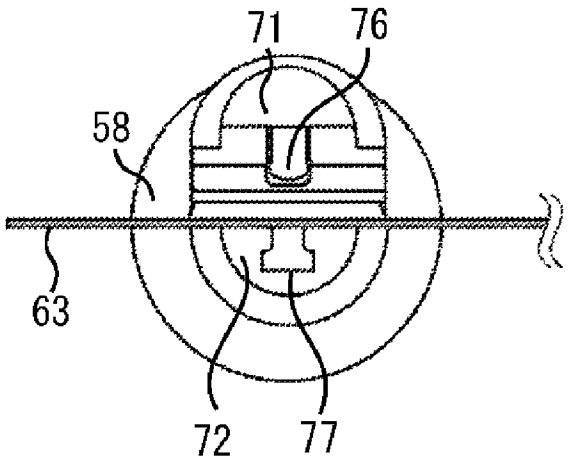
FIGS. 9A and 9B illustrate the winding member before the winding member holds the sealing member according to a second exemplary embodiment of the present invention.
Figure 9A:
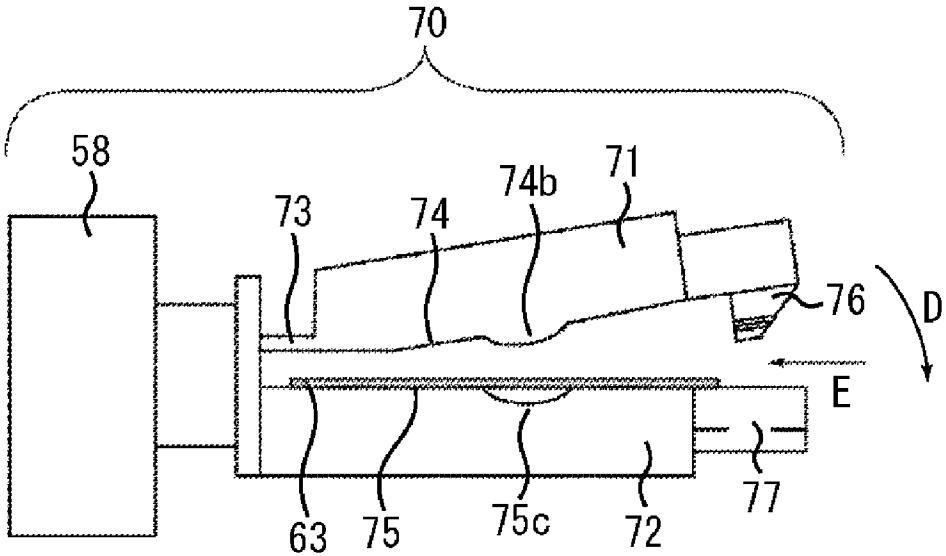

FIGS. 9A and 9B illustrate the winding member 70 before the winding member 70 holds the sealing member 63. More specifically, FIG. 9A illustrates the winding member 70 as seen from a direction perpendicular to the rotational axis of the winding member 70. FIG. 9B illustrates the winding member 70 as seen from the direction of the rotational axis of the winding member 70.

The winding member 70 includes a movable portion 71 and a fixed portion 72 which are bifurcated in a direction intersecting the rotational axis of the winding member 70. The movable portion 71 includes a thin-walled portion 73. Further, the movable portion 71 includes a first holding portion 74 and the fixed portion 72 includes a second holding portion 75. When the movable portion 71 is deformed in a direction indicated by an arrow D illustrated in FIG. 9A so that the thin-walled portion 73 is bent, the first holding portion 74 and the second holding portion 75 hold the sealing member 63.

The first holding portion 74 includes an L-shaped surface opposing a surface adjacent to the first holding portion 74 near the base of the bifurcated portion, when viewed along the intersecting direction.

Further, a convex curved surface 74*b* and a concave curved surface 75*c* are disposed in the first holding portion 74 and the second holding portion 75 respectively. The convex curved surface 74*b* biases the sealing member 63 when the sealing member 63 is held between the first holding portion 74 and the second holding portion 75. The concave curved surface 75*c* is formed to avoid interference with the convex curved surface 74*b*.

Further, a convex portion 76 is disposed on the movable portion 71 and the concave portion 77 is disposed on the fixed portion 72 to keep holding state of the sealing member 63. The sealing member 63 is inserted between the first holding portion 74 and the second holding portion 75 of the winding member 70 from a direction indicated by an arrow E illustrated in FIG. 9A.

Figure 10B:
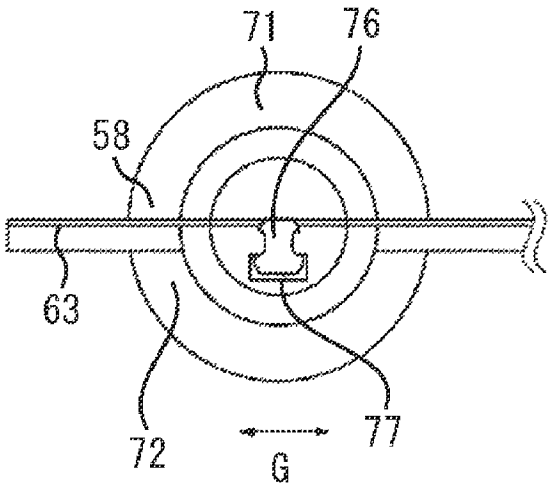
FIGS. 10A and 10B illustrates the winding member when holding the sealing member according to the second exemplary embodiment of the present invention.
Figure 10A:
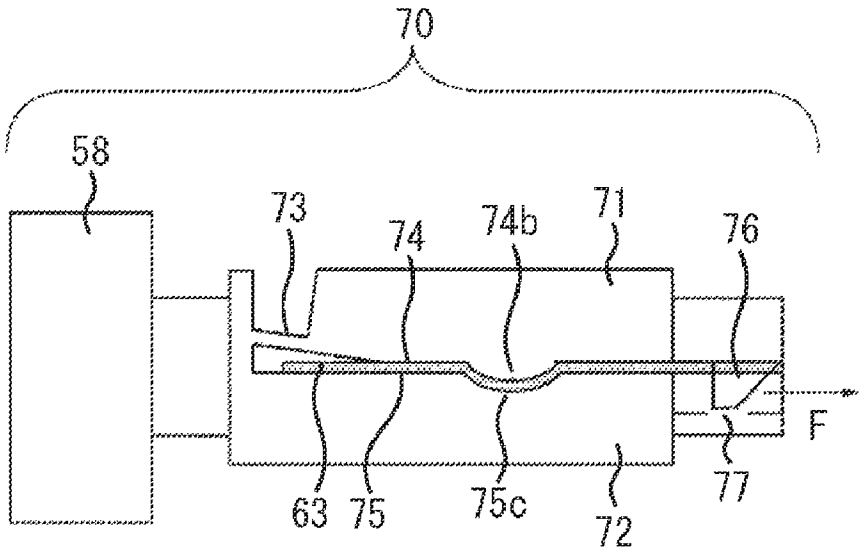

FIGS. 10A and 10B illustrate the winding member when holding the sealing member 63. More specifically, FIG. 10A illustrates the winding member 70 as seen from a direction perpendicular to the rotational axis of the winding member 70, and FIG. 10B illustrates the winding member 70 as seen from the direction of the rotational axis of the winding member 70.

The first holding portion 74 and the second holding portion 75 hold the sealing member 63 by bending the thin-walled portion 73 and moving the movable portion 71 toward the fixing portion 72. As a result, the convex curved surface 74*b* biases the sealing member 63, and the sealing member 63 is kept held by the convex portion 76 by engaging with the concave portion 77.

When the winding member 70 holds the sealing member 63, the sealing member 63 is prevented from sliding off in a direction indicated by an arrow F illustrated in FIG. 10A by the convex portion 76, i.e., an engaging portion.

Further, the convex curved surface 74*b* sinks deeper into the concave curved surface 75*c* (i.e., the convex curved surface 74*b* enters the concave curved surface 75*c*) as compared to other portions on the second holding portion 75. Therefore, the sealing member 63 is firmly biased even if the space between the first holding portion 74 and the second holding portion 75 varies within dimensional tolerance.

As a result, the sealing member 63 is firmly held and is prevented from sliding off in a direction indicated by an arrow G illustrated in FIG. 10B.

As described above, according to the present exemplary embodiment, the sealing member 63 and the winding member 70 which winds the sealing member 63 can be easily and firmly fixed, even if the convex curved surface 74*b* biases the sealing member 63.

Further, manufacturing cost can be reduced by a decrease in the number of components, and assembling efficiency is improved by preventing the sealing member 63 from sliding off from the winding member holding portion. Further, winding performance can be improved by preventing the sealing member 63 to slide off from the holding portion of the winding member 70 when the winding member 70 rotates to remove the sealing member 70. That is, the present exemplary embodiment can achieve the similar effects to those of the first exemplary embodiment.

Moreover, since the curved surface biases the sealing member 63 in the present exemplary embodiment, it is less likely for the sealing member 63 to be scratched. Therefore, the present exemplary embodiment is effective when the sealing member 63 is formed by a material that can be torn easily.

A third exemplary embodiment according to the present invention will be described below with reference to FIGS. 11A, 11*b*, and 11C.

In the present exemplary embodiment, developing apparatus, process cartridge, image forming apparatus, and sealing member removal mechanism are similar to those described in the first exemplary embodiment, except for the winding member 70. Therefore, the same reference number will be assigned to components of the similar function and the similar configuration, and detailed description will be omitted.

A configuration of the winding member according to the present exemplary embodiment will be described below with reference to FIGS. 11A, 11B, and 11C.

Figure 11A:
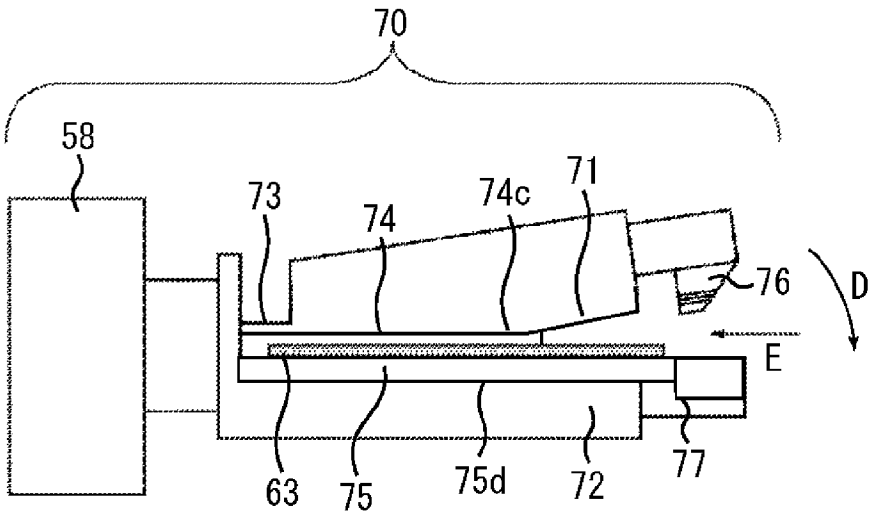
FIGS. 11A, 11B, and 11C illustrate the winding member before the winding member holds the sealing member according to a third exemplary embodiment of the present invention.
Figure 11B:
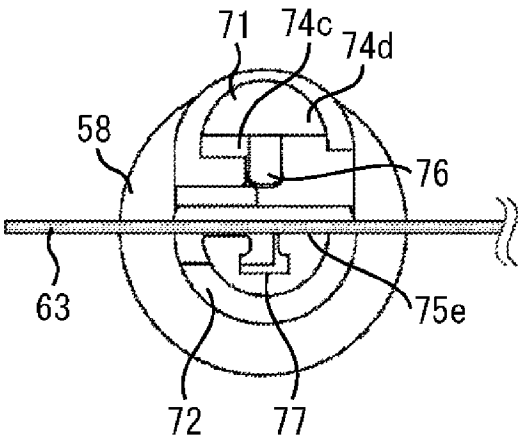
Figure 11C:
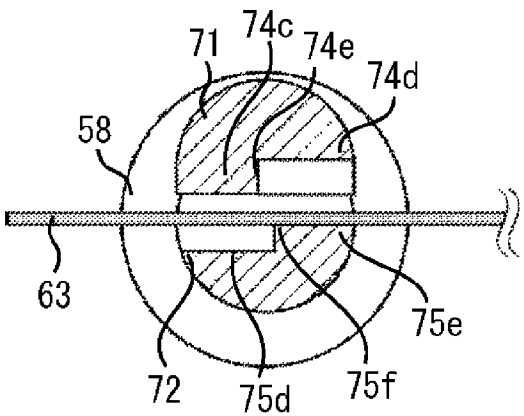

FIGS. 11A, 11B, and 11C illustrate the winding member 70 before the winding member 70 holds the sealing member 63. More specifically, FIG. 11A illustrates the winding member 70 as seen from a direction perpendicular to the rotational axis of the winding member 70. FIG. 11B illustrates the winding member 70 as seen from the direction of the rotational axis of the winding member 70. FIG. 11C illustrates a cross-sectional view of the holding portion of the winding member 70.

The winding member 70 includes a movable portion 71 and a fixed portion 72 which are bifurcated in a direction intersecting the rotational axis of the winding member 70. The movable portion 71 includes a thin-walled portion 73. Further, the movable portion 71 includes a first holding portion 74, so that the sealing member 63 is held when the movable portion 71 is deformed in the direction indicated by an arrow D illustrated in FIG. 9A and the thin-walled portion is thus bent. Further, the fixed portion 72 includes a second holding portion 75.

The first holding portion 74 includes an L-shaped surface opposing a surface adjacent to the first holding portion 74 near the base of the bifurcated portion along the intersecting direction.

Further, a convex portion 74*c* and a concave portion 75*d* are disposed on the first holding portion 74 and the second holding portion 75 respectively. The convex portion 74*c* biases the sealing member 63 when the first holding portion 74 and the second holding portion 75 hold the sealing member 63. The concave portion 75*d* is formed to avoid interference with the convex portion 74*c*. Further, a concave portion 74*d* and a convex portion 75*e* are disposed within the first holding portion 74 and the second holding portion 75 respectively. The convex portion 75*e* biases the sealing member 63 when the sealing member 63 is held between the first holding portion 74 and the second holding portion 75. The concave portion 74*d* is formed to avoid interference with the convex portion 75*e*.

When the holding portion is closed, the convex portion 74*c* enters the concave portion 75*d*, and the convex portion 75*e* enters the concave portion 74*d*. Further, a convex portion 76 is disposed on the movable portion 71 and a concave portion 77 is disposed on the fixed portion 72 to keep the sealing member 63 held when the holding portion is closed.

The sealing member 63 is inserted between the first holding portion 74 and the second holding portion 75 of the winding member 70 from a direction indicated by an arrow E illustrated in FIG. 12A.

FIGS. 12A, 12B, and 12C illustrate the winding member 70 when holding the sealing member 63. FIG. 12A illustrates the winding member 70 as seen from the direction perpendicular to the rotational axis of the winding member 70. FIG. 12B illustrates the winding member 70 as seen from the direction of the rotational axis of the winding member 70. FIG. 12C illustrates a cross-sectional view of the holding portion of the winding member 70.

Referring to FIG. 12A, the first holding portion 74 and the second holding portion 75 hold the sealing member 63 by bending the thin-walled portion 73 and moving the movable portion 71 toward the fixing portion 72.

The convex portion 74*c* on the first holding portion 74 then biases the sealing member 63, and the convex portion 76 of the movable portion 71 is engaged with the concave portion 77 of the fixed portion 72. The sealing member 63 is thus kept held.

When the winding member 70 is holding the sealing member 63, the convex portion 76, i.e., the engaging portion, prevents the sealing member 63 from sliding off in a direction indicated by an arrow E illustrated in FIG. 12A.

Further, the sealing member 63 is firmly held at two points, i.e., a convex portion corner 74*e* and a convex portion corner 75*f* illustrated in FIG. 12C. Therefore, the sealing member 63 is prevented from sliding off in a direction indicated by an arrow G illustrated in FIG. 12B, even if the space between the first holding portion 74 and the second holding portion 75 varies within dimensional tolerance.

As describe above, according to the present exemplary embodiment, the sealing member 63 and the winding member 70 which winds the sealing member 63 can be easily and firmly fixed, even if a crank surface as seen from the direction of the rotational axis of the winding member 70 biases the sealing member 63.

Further, manufacturing cost can be reduced by a decrease in the number of components, and winding performance can be improved by preventing the sealing member 63 from sliding off from the winding member holding portion. Further, the winding performance can be improved by preventing the sealing member to slide off from the holding portion of the winding member 70 when the winding member 70 rotates to remove the sealing member 70.

Further, since the sealing member 63 is biased by a crank surface, frictional force is generated when the sealing member 63 slides on the convex portion corner 74*e* and the convex portion corner 75*f* if the sealing member 63 is pulled in a direction of sliding off (i.e., direction indicated by the arrow G) from the winding member 70, in addition to the holding force. Therefore, it becomes more difficult for the sealing member 63 to slide off from the winding member 70.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A winding member that winds a sealing member that seals an opening of a developer storage unit, the winding member comprising:

a first holding portion including a convex portion; and a second holding portion including a concave portion, configured to hold the sealing member between the first and second holding portions, wherein an end of the first holding portion and an end of the second holding portion are connected, so that the first and second holding portions are relatively movable, and wherein the sealing member is held between the convex portion and concave portion.

2. The winding member according to claim 1, wherein a first engaging portion is disposed at another end of the first holding portion, a second engaging portion is disposed at another end of the second holding portion, and the second engaging portion is configured to be engaged with the first engaging portion.

3. The winding member according to claim 2, wherein the sealing member is locked between a connecting point at which the first and second holding portion are connected, and an engaging point at which the first and second engaging portions are engaged.

4. The winding member according to claim 2, further comprising a force receiving portion configured to receive force for winding the sealing member, wherein a connecting point at which the first holding portion and the second holding portion are connected is located between the force receiving portion and an engaging point at which the first and the second engaging portions are engaged, in a direction of a rotational axis.

5. The winding member according to claim 1, wherein the first holding portion includes an inclined surface inclined in a direction away from the second holding portion in a connecting point side, compared to the convex portion, at which the first and second holding portions are connected.

6. The winding member according to claim 1, wherein the concave portion is formed in a direction which is approximately perpendicular to a rotational axis of the winding member.

7. The winding member according to claim 1, wherein the convex portion is formed in a direction which is approximately perpendicular to a rotational axis of the winding member.

8. A cartridge comprising:

a developer storage unit having an opening;

a sealing member configured to seal the opening;

a winding member configured to wind the sealing member by rotating, including a first holding portion with a convex portion; and a second holding portion with a concave portion, configured to hold the sealing member between the first and second holding portions, wherein an end of the first holding portion and an end of the second holding portion are connected, so that the first and second holding portions are relatively movable, and the winding member holds the sealing member between the convex portion and the concave portion.

9. The cartridge according to claim 8, wherein a first engaging portion is disposed at another end of the first holding portion, a second engaging portion is disposed at another end of the second holding portion, and the second engaging portion is configured to be engaged with the first engaging portion.

10. The cartridge according to claim 9, wherein the sealing member is locked between a connecting point at which the first and second holding portions are connected, and an engaging point at which the first and second engaging portions are engaged.

11. The cartridge according to claim 9, wherein the winding member further comprises a force receiving portion configured to receive force for winding the sealing member, and wherein a connecting point at which the first holding portion and the second holding portion are connected is located between the force receiving portion and an engaging point at which the first and the second engaging portions are engaged, in a direction of a rotational axis.

12. The cartridge according to claim 8, wherein the first holding portion includes an inclined surface inclined away from the second holding portion, nearer to the connecting point than the convex portion.

13. The cartridge according to claim 8, wherein the concave portion is formed in a direction which is approximately perpendicular to a rotational axis of the winding member.

14. The cartridge according to claim 8, wherein the convex portion is formed in a direction that is approximately perpendicular to a rotational axis of the winding member.

15. The cartridge according to claim 8, wherein the sealing member winds the sealing member itself by rotating the winding member.

* * * * *